US005369836A

United States Patent [19]

Horne

[11] Patent Number: 5,369,836

[45] Date of Patent: Dec. 6, 1994

[54] CEILING FAN BLADE CLEANER

[76] Inventor: Bonnie G. Horne, 15 Indian Creek Trail, Sharpsburg, Ga. 30277

[21] Appl. No.: 102,293

[22] Filed: Aug. 5, 1993

[51] Int. Cl.[5] ..... A47L 25/00

[52] U.S. Cl. ..... 15/210.1

[58] Field of Search ..... 15/210.1, 229.3, 229.4, 15/220.4, 97.1, 102, 229.7, 209.1; 150/154, 157, 166

[56] References Cited

U.S. PATENT DOCUMENTS

| | | | |
|---|---|---|---|
| D. 296,022 | 5/1988 | Restivo | 15/210.1 |
| D. 328,373 | 7/1992 | Murray | 15/210.1 |
| D. 341,452 | 11/1993 | Songer | 15/210.1 |
| 2,575,361 | 11/1951 | Reip | 15/220.4 |
| 3,034,787 | 5/1962 | Brown | 15/210.1 |
| 4,823,431 | 4/1989 | Carpenter | 15/210.1 |
| 4,827,556 | 5/1989 | Corsetti | 15/210.1 |
| 4,841,592 | 6/1989 | Restivo | 15/210.1 |
| 5,018,944 | 5/1991 | Bielecki et al. | 15/256.5 |
| 5,235,722 | 8/1993 | Harris et al. | 15/394 |

*Primary Examiner*—David A. Scherbel
*Assistant Examiner*—Gary K. Graham
*Attorney, Agent, or Firm*—Hugh E. Smith

[57] ABSTRACT

A ceiling fan blade cleaner including a flexible, flat tubular, textile sleeve of sufficient length to completely encase a fan blade from tip to root, a flat spring member to cause said sleeve to conform to the blade surfaces and a pair of metal plates to releasably engage the root end of said sleeve and to withdraw said sleeve in wiping engagement with the surfaces of said blade to remove dirt therefrom and to trap such dirt as it is removed.

3 Claims, 4 Drawing Sheets

CEILING FAN BLADE CLEANER

BACKGROUND OF THE INVENTION

1. Field of the Invention

The present invention relates to blade cleaners and more particularly pertains to such cleaners which may be readily engaged with an overhead ceiling fan blade to clean the surfaces thereof and to trap dirt removed therefrom.

2. Description of the Prior Art

The use of ceiling fan blade cleaners are known in the prior art. More specifically, such cleaners heretofore devised and utilized for the purpose of cleaning overhead fan blades are known to consist basically of familiar, expected and obvious structural configurations, notwithstanding the myriad of designs encompassed by the crowded prior art which have been developed for the fulfillment of countless objectives and requirements. Such cleaners have generally been of a finite length, covering only a portion of the blade length at any given point in the cleaning process with resultant displacement of the dust as the cleaner is run over the blade. The dust is free to fall from the blade surface and since it usually is oily in nature it will readily fall and contaminate the floors or other surfaces below the ceiling fan. Representative of such prior art devices are those shown in U.S. Pat. Nos. 4,823,431; 4,458,375; 5,018,944; 4,841,592; and 4,827,556.

In this respect, the ceiling fan blade cleaner according to the present invention substantially departs from the conventional concepts and designs of the prior art, and in so doing provides an apparatus primarily developed for the purpose of both cleaning and trapping the oily dirt and grease from the surface of ceiling fan blades.

Therefore, it can be appreciated that there exists a continuing need for new and improved fan blade cleaner which can be utilized to also trap removed dirt. In this regard, the present invention substantially fulfills this need.

SUMMARY OF THE INVENTION

In view of the foregoing disadvantages inherent in the known types of fan blade cleaners now present in the prior art, the present invention provides an improved cleaner construction wherein the same can be utilized to readily clean overhead blades and to prevent dirt removed by such cleaning from falling down to surfaces below. As such, the general purpose of the present invention, which will be described subsequently in greater detail, is to provide a new and improved ceiling fan blade cleaner apparatus which has all the advantages of the prior art cleaners and none of the disadvantages.

To attain this, the present invention essentially relates to a ceiling fan blade cleaner which comprises: a flexible, flat tubular, textile sleeve of sufficient length to completely encase a fan blade from tip to root; means to cause said sleeve to conform to the blade surfaces; and means to releasably engage the root end of said sleeve and to withdraw said sleeve in wiping engagement with the surfaces of said blade to remove dirt therefrom and to trap such dirt as it is removed.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ceiling fan blade cleaner which has all the advantages of the prior art devices and none of the disadvantages.

It is another object of the present invention to provide a new and improved ceiling fan blade cleaner which may be easily and efficiently manufactured and marketed.

It is a further object of the present invention to provide a new and improved ceiling fan blade cleaner which is of a durable and reliable construction.

An even further object of the present invention is to provide a new and improved ceiling fan blade cleaner which is susceptible of a low cost of manufacture with regard to both materials and labor, and which accordingly is then susceptible of low prices of sale to the consuming public, thereby making such cleaners economically available to the buying public.

Still yet another object of the present invention is to provide a new and improved ceiling fan blade cleaner which provides in the apparatuses and methods of the prior art some of the advantages thereof, while simultaneously overcoming some of the disadvantages normally associated therewith.

Still another object of the present invention is to provide a new and improved ceiling fan blade cleaner which entraps the dirt removed during the cleaning.

Yet another object of the present invention is to provide a new and improved ceiling fan cleaner which can be placed over an overhead blade and removed therefrom while the operator remains standing on the floor below such fan.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
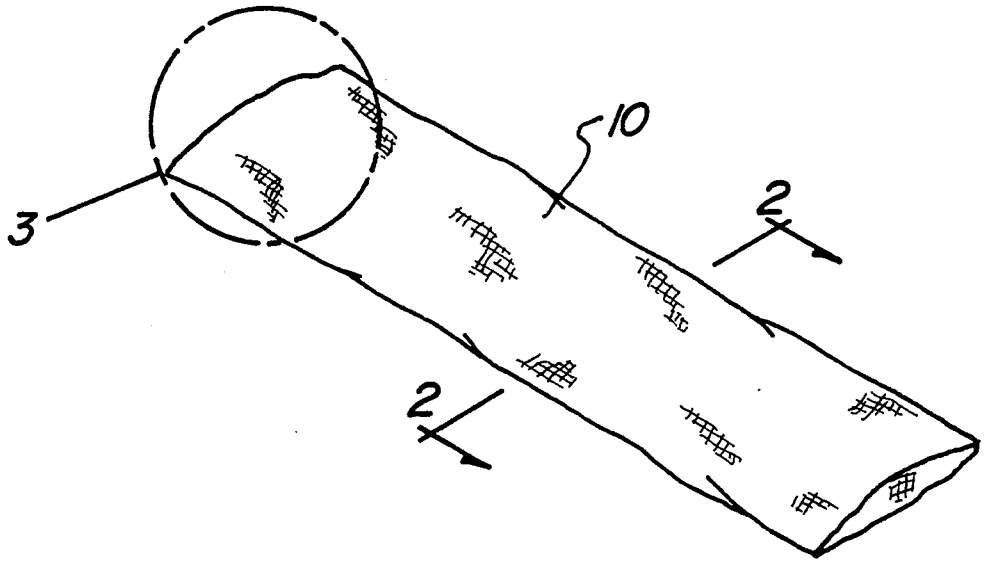
FIG. 1 is a perspective view of the sleeve portion of the device of the present invention.

With reference now to the drawings, and in particular to FIG. 1 thereof, a new and improved ceiling fan blade cleaner embodying the principles and concepts of the present invention and generally designated by the reference numeral 10 will be described.

Figure 2:
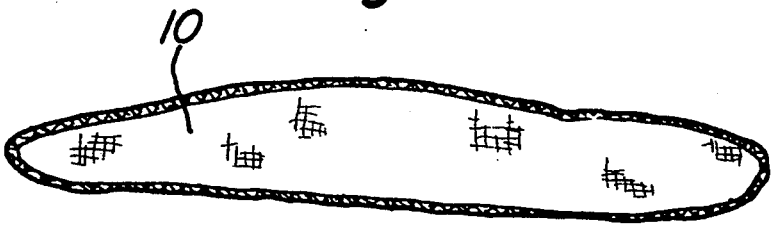
FIG. 2 is a cross-section on line 2—2 of FIG. 1.

The most important component of the device of the present invention is the dirt wiping and trapping flat sleeve 10. Contrary to the prior art devices, this blade-engaging tubular sleeve is of a width to closely fit over the blade to be cleaned and of a length sufficient to encase the full length of the blade from tip to root. As shown in FIGS. 1 and 2 the sleeve is generally oval in cross-section and is designed to engage with both the upper and lower surfaces of the fan blade to be cleaned. As most clearly seen in FIG. 2, the sleeve 10 is formed of a fine porous textile material (either woven or non-woven in construction). The pores constitute dirt trapping pockets for dust, etc. removed from the blade surfaces by the wiping action of the sleeve 10.

Figure 3:
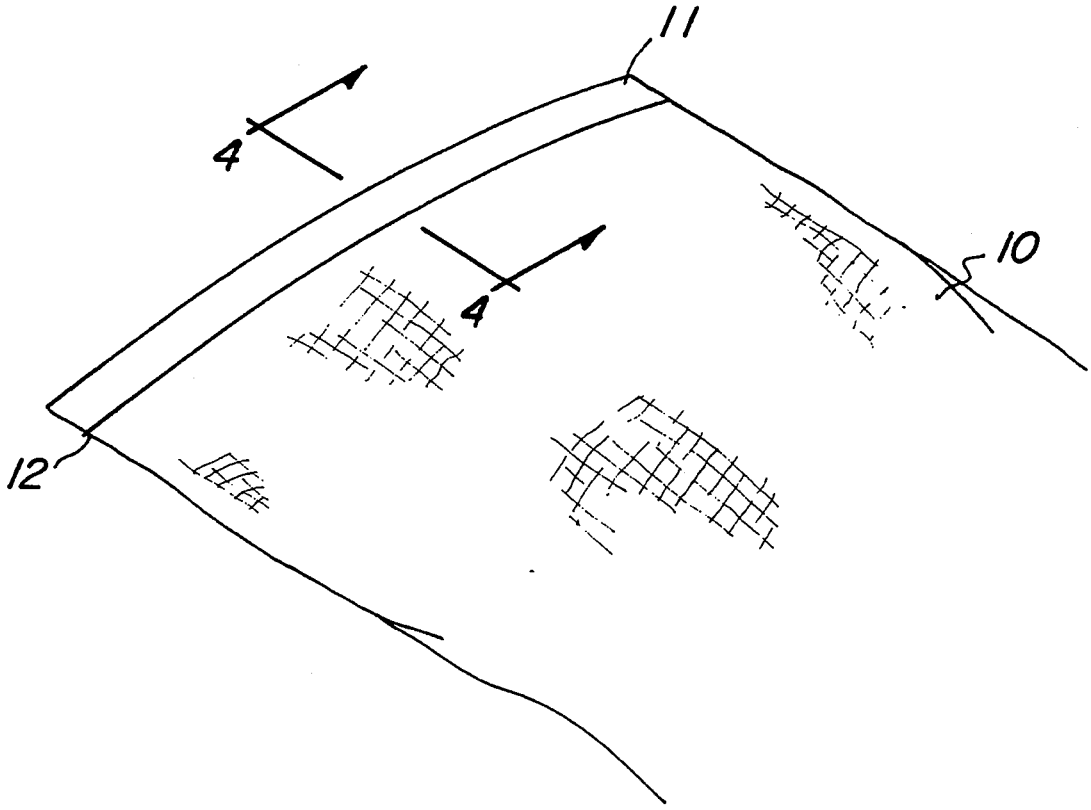
FIG. 3 is a perspective view of the tip end of the sleeve of FIG. 1 and constitutes an enlarged view of the portion circled and identified by the numeral "3" on FIG. 1.
Figure 4:
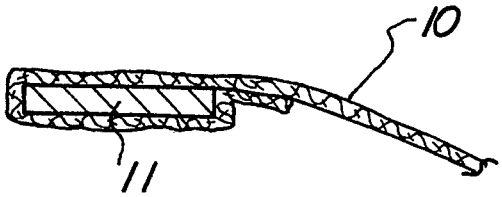
FIG. 4 is a sectional view of the upper surface of the sleeve taken on line 4—4 of FIG. 3.

In order to maintain the sleeve 10 in a transversely taut condition, a flat metal spring member 11 is affixed to the top and bottom of the textile material of sleeve 10 at the tip end 12 of such sleeve 10 as is shown in FIGS. 3 and 4.

Figure 5:
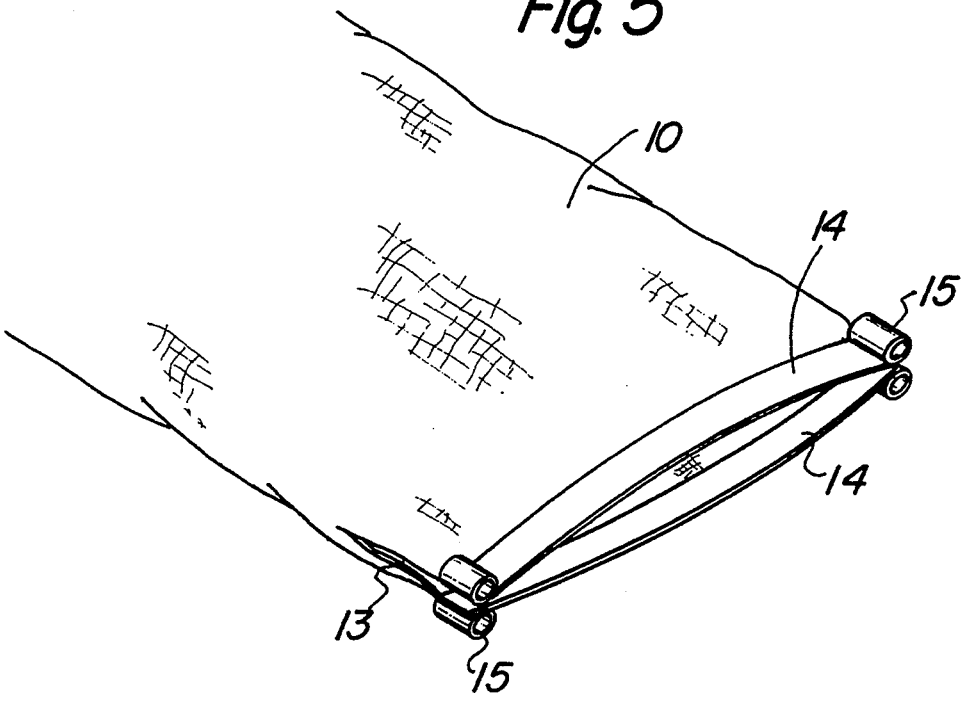
FIG. 5 is a perspective view of the root end of the sleeve portion of the device of the present invention.

FIG. 5 illustrates that at the entry or root end 13 of sleeve 10, a second set of flat metal plates 14 are affixed to the top and bottom to the textile material of sleeve 10. The outer ends of flat plates 14 are rolled to form open tubular section 15 which will engage with the maneuvering portion 16 of the present invention as shown in FIGS. 6, 7 and 8 below.

Figure 6:
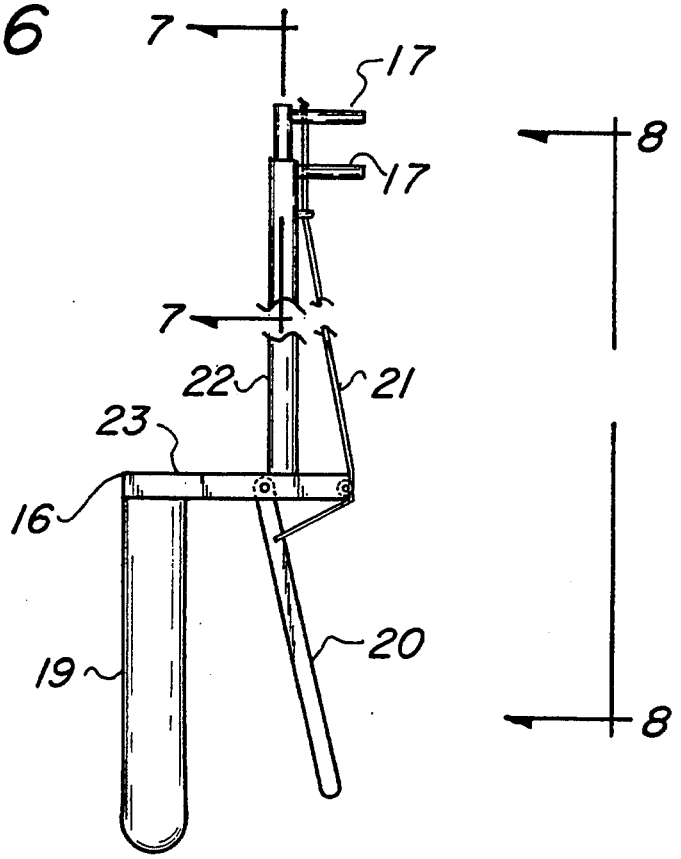
FIG. 6 is a side plan view of the engaging and maneuvering device portion of the present invention.
Figure 7:
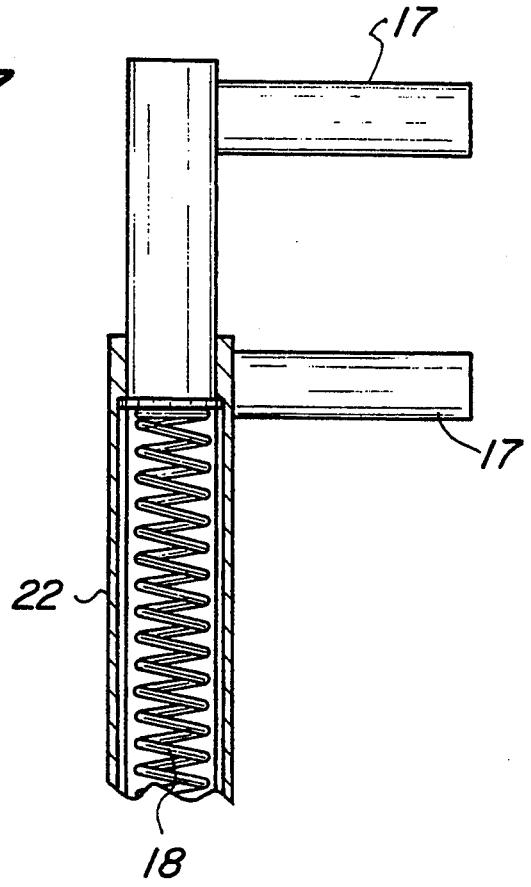
FIG. 7 is a partial sectional view on line 7—7 of FIG. 6.

FIG. 6 is a side plan view of such engaging and maneuvering portion 16 which has projecting finger member 17 adapted to fit within tubular sections 15. These finger members 17 are normally held in spaced relationship to each other by a spring 18 as shown in FIG. 8. When fingers 17 are inserted in tubular sections 15, this normal relationship causes the flat plates 14 to be positioned in a spaced relationship for placement of the device 10 over the fan blade to be cleaned. By squeezing trigger member 20 towards the handle 19, a cable attached to the base of trigger 20 and to the top finger 17 causes the fingers to be drawn together thus allowing flat plates to move into a close proximal relationship relative one to the other. In this configuration the material of sleeve 10 will be drawn into contact with the surfaces of the fan blade encased thereby and as it is pulled off such blade will wipe and entrap the dirt from such surfaces.

Figure 8:
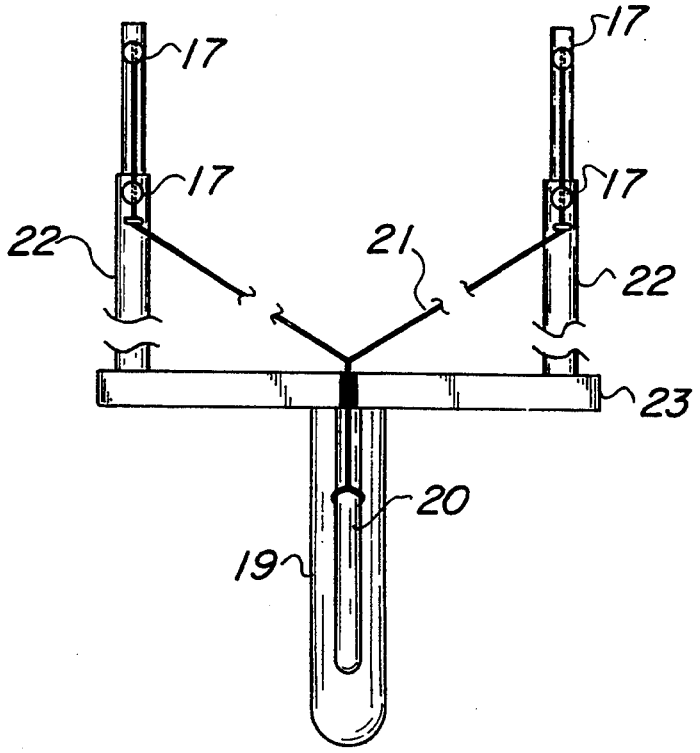
FIG. 8 is a front plan view of the portion of the device shown in FIG. 6.

As illustrated in FIG. 8, finger members 17 are normally held in the spaced apart relationship by action of spring 18. FIG. 8 shows that maneuvering portion 16 has a pair of the support arms 22 for finger members 17 affixed to a transverse base plate 23 to the bottom center of which is fastened handle 19 and associated trigger member 20. The cable 21 arrangement described and shown in connection with FIG. 6 is likewise duplicated.

In operation, the root end 13 of sleeve 10 is fed over the tip end of the fan blade by using the maneuvering portion 16, with trigger 19 in released position, such that the sleeve is easily slipped full-length over the blade. Depressing the trigger 19 then causes the sleeve 10 to engage tightly with the blade and as it is withdrawn, dirt and dust on the surfaces of such blade is removed therefrom. Because sleeve 10 fits over the entire blade, any such displaced dirt or dust is retained within sleeve 10 and is entrapped in the pores of the textile material forming such sleeve. Usually all of the blades of a conventional fan can be so cleaned before sleeve 10 becomes too dirty. Should this happen, the sleeve 10, once withdrawn can be removed from fingers 17 and turned inside out and/or vacuumed. When cleaning is completed, sleeve 10 may be washed, dried and made ready for further use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. For example, if desired, the arched flat plates at the tip end of sleeve 10 may be duplicated at the root end of such sleeve, including the rolled tubular sections 15 thereon and the finger members 17 be made long enough to engage such tubular sections 15 at both ends of sleeve 10 making both insertion of the blade into the sleeve 10 and gripping of the blade by such sleeve more positive.

What is claimed as being new and desired to be protected by Letters Patent of the United States is as follows:

1. A ceiling fan blade cleaner for cleaning a blade of a ceiling fan, said blade having a blade tip end and a blade root end, said cleaner comprising:

a flexible, flat, elongated, tubular, textile sleeve for completely encasing said fan blade from said blade tip end to said blade root end thereof, said sleeve having a closed sleeve tip end and an openable sleeve root end;

means to cause said sleeve tip end of said sleeve to conform to said blade so encased;

and, means to open said root end of said sleeve for sliding said sleeve onto said blade and further to close said root end of said sleeve about said blade, whereby said sleeve can be withdrawn from said blade in wiping) therewith to remove and entrap dirt from said blade within said sleeve.

2. A cleaner as in claim 1 wherein said means to cause said sleeve tip end of said sleeve to conform to said blade comprises at least one spring member coupled to said sleeve tip end of said sleeve, thereby stretching said sleeve to maintain said sleeve tip end of said sleeve in a transversely taut condition.

3. A cleaner as in claim 1, and further comprising a first flat plate coupled to said sleeve root end, a second flat plate coupled to said sleeve root end, said flat plates being separable to open said sleeve root end, each of said plates having a pair of tubular sections formed therein, wherein said means to releasably engage said root end of said sleeve to open said sleeve comprises a handle, a trigger member pivotally coupled to said handle, a transverse member mounted to said handle and extending orthogonally relative to said handle, said transverse member having a first end and a second end, a first elongated support arm orthogonally coupled to said first end of said transverse member, a second elongated support arm orthogonally coupled to said second end of said transverse member, a first pair of fingers movably mounted to said first support arm, and a second pair of fingers movably mounted to said second support arm, wherein said fingers are mechanically coupled to said trigger and removably engaged to said tubular sections of said flat plates so as to effect movement of said flat plates in response to a movement of said trigger.

* * * * *